United States Patent [19]

Gatzka et al.

[11] Patent Number: 4,890,429

[45] Date of Patent: Jan. 2, 1990

[54] BUILDING TRUSS

[75] Inventors: Bruno G. Gatzka, Porepunkah; Christopher J. Olsen, East Lavington, both of Australia

[73] Assignee: Starch Industries, Pty. Ltd., Albury, Australia

[21] Appl. No.: 135,490

[22] Filed: Nov. 24, 1987

Related U.S. Application Data

[63] Continuation of Ser. No. 872,577, Jun. 10, 1986, abandoned.

[30] Foreign Application Priority Data

Mar. 13, 1986 [AU] Australia ..... PH5022

[51] Int. Cl.[4] ..... E04B 1/343

[52] U.S. Cl. ..... 52/640; 52/227; 52/641; 52/644; 52/692; 52/693

[58] Field of Search ..... 52/691, 639, 640, 641, 52/644, 645, 227, 692, 643

[56] References Cited

U.S. PATENT DOCUMENTS

| | | | |
|---|---|---|---|
| 1,915,424 | 6/1933 | Kerr | 52/691 |
| 1,985,599 | 12/1934 | Cates et al. | 52/643 |
| 2,021,480 | 11/1935 | Davidson | 52/639 |
| 2,415,240 | 2/1947 | Fouhy | 52/639 |
| 2,415,461 | 2/1947 | Causey | 52/691 |
| 2,578,465 | 12/1951 | Davis, Jr. et al. | 52/691 |
| 2,636,457 | 4/1953 | Finlay et al. | 52/644 |
| 2,693,195 | 11/1954 | Frieder et al. | 52/644 |
| 2,793,720 | 5/1957 | Hawes | 52/645 |
| 3,091,313 | 5/1963 | Colbath | 52/691 |
| 3,377,637 | 4/1968 | Zamorano | 52/639 |
| 3,530,622 | 9/1970 | Cohen | 52/640 |
| 3,826,057 | 7/1974 | Franklin | 52/641 |
| 3,857,213 | 12/1974 | Miyake | 52/227 |
| 4,259,825 | 4/1981 | Hedgepath et al. | 52/645 |
| 4,275,537 | 6/1981 | Pinson | 52/691 |
| 4,353,190 | 10/1982 | Gleeson | 52/691 |
| 4,393,637 | 7/1983 | Mosier | 52/225 |

FOREIGN PATENT DOCUMENTS

| | | | |
|---|---|---|---|
| 505679 | 2/1976 | Australia . | |
| 535636 | 3/1983 | Australia . | |
| 416010 | 11/1946 | Italy | 52/644 |
| WO/585 | 4/1980 | PCT Int'l Appl. | 52/641 |

*Primary Examiner*—Michael Safavi

*Attorney, Agent, or Firm*—Griffin, Branigan, Butler

[57] ABSTRACT

The invention relates to a building truss having an intermediate flexible section and two end stiff sections. The truss is formed of upper and lower chord(s) with the lower chord(s) of the intermediate section having a plurality of lengths of tube slidably received over a tensioning cable. By tensioning the cable the truss is bowed upwardly to form an arcuate truss.

4 Claims, 7 Drawing Sheets

BUILDING TRUSS

This is a continuation of application Ser. No. 872,577, filed June 10, 1986, now abandoned.

The present invention relates to trusses, structures incorporating such trusses and method of constructing such structures.

Trusses which form the basis of the present invention are disclosed in Australian Patent Specification Nos. 505,679 and 535,636. Such trusses when used for building a structure offer large covered area at a substantially reduced cost compared with conventional building construction methods. The limitations of the structures made in accordance with these patents are the maximum heights that can be achieved. The relative shallow arcs that are imposed on the trusses are the major limiting factor in this respect.

In addition the raising of the structure disclosed in 505,679 is rather awkward in that cranes or airbags must be used resulting in increased cost and labour. The erection method shown in 535,636 is cost-effective and less awkward in use. One end of the truss is pinned whilst the other end is tensioned causing the unpinned end to move inwardly and increase the curvature of the truss.

Accordingly it is an object of the present invention to provide a truss which can be used to form taller structures than the previously described trusses.

A further object of the present invention is to provide a truss which does not require cranes or airbags to erect.

A still further object of the invention is to provide an economical method of constructing a building structure.

With these objects in view the present invention in one aspect provides a truss having at least one upper chord and at least one lower chord, interconnected by diagonal web members, said truss including an intermediate section and two end stiff sections, the lower chord(s) of said intermediate section being formed of a plurality of lengths of tube slidably received over at least one high tensile cable, said lower chord(s) of said intermediate section being downwardly bowed, wherein by shortening the length of said truss and tensioning said cable(s) said lower chord(s) of said intermediate section are shortened and said intermediate section flexes upwardly to be movable to an erected condition at which said tube members are in overlapping and/or abutting relationship.

A practical embodiment of the invention will be now described with reference to the non-limitative example illustrated in the accompanying drawings, in which.

Figure 1:
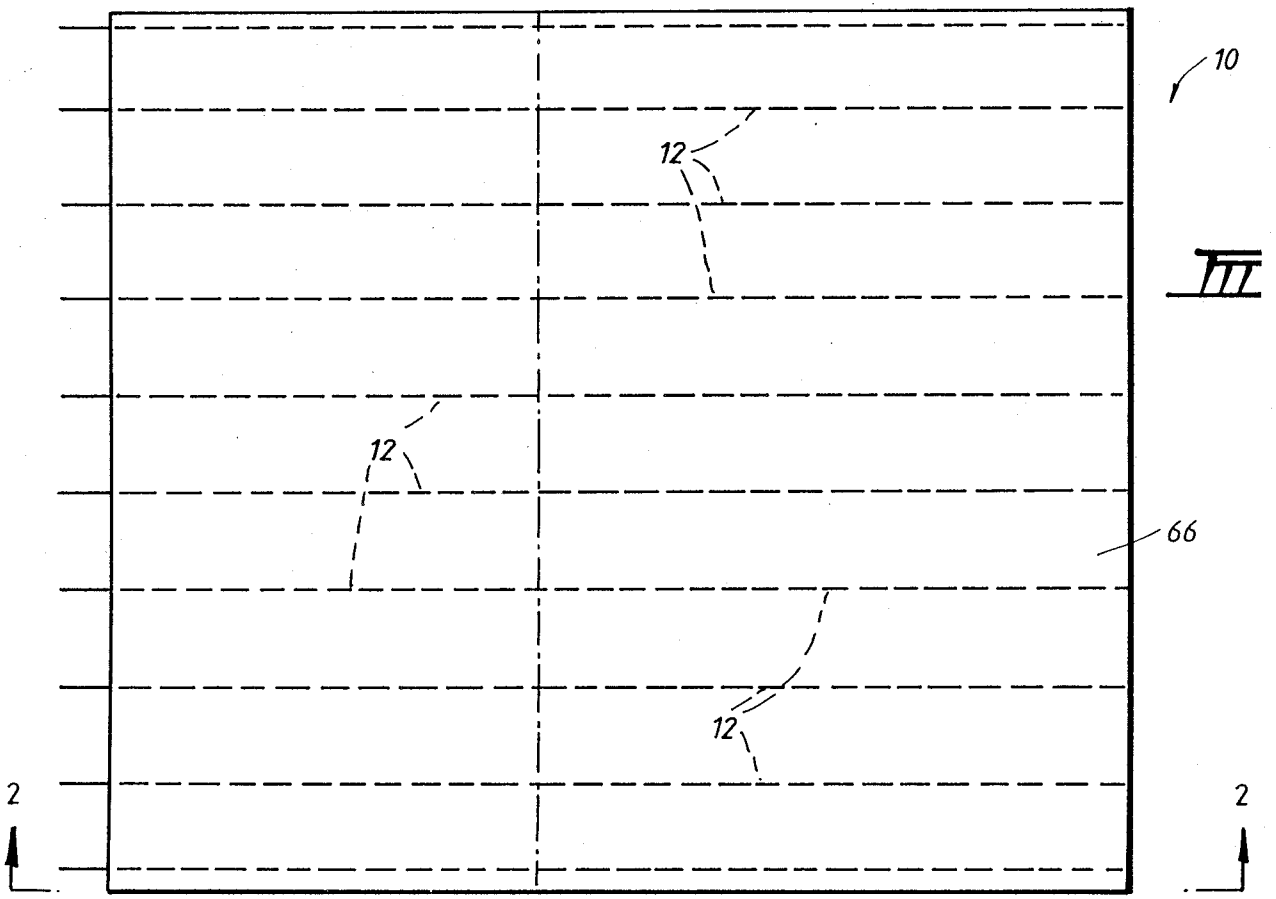
FIG. 1 is a plan view of a building to be erected according to the principles of the present invention.

In the drawings there is shown a building 10 formed using a plurality of trusses 12. Each truss 12 includes two end sections 14 and an intermediate section 16. The end sections 14 are rigid and form the wall of the completed building. Each end section is formed of an upper chord 18 and a lower chord 20. The upper and lower chords 18 and 20 are spaced apart by diagonal web members 22 configured in a zig-zag fashion. In this embodiment the upper chord is formed by a pair of rigid tubes 18A, 18B with the lower chord being formed from a channel section. The number and shape of the sections forming the upper and lower chords can vary depending on requirements.

At each end of the end sections 14 are ground engaging points 24 26 the attachment of which will be described later. The ground engaging point is formed at the end of a triangular framework 28 comprising an angular extension 30 of lower chord 20, strut member 32 and diagonal web member 22. Additional strengthening struts 34 complete the triangular framework.

The intermediate section 16 comprises an upper chord 36 and a lower chord 38. The upper chord 36 is continuous extension of the upper chords 18 of end sections 14 and as described previously the upper chord is formed of a pair of tubes 36A and 36B. Each tube 36A, 36B is linked by a web 39 for structural integrity. Lower chord 38 is formed from two discontinuous tubes 38A, 38B which each of is adapted to be telescoped within itself through reduced diameter end sections 40. Although this embodiment uses two tubes 38A, 38B the number may vary depending on requirements. Increasing the number of tubes used increases the tension that can be applied and the span of the completed building. The tubes 38A, 38B are spaced from upper chord 36 by insertion in rectangular nodal connectors 42 which are secured to diagonal web members 44. To complete the intermediate section high tension cables 46, 48 are threaded through tubes 38A and 38B respectively.

Figure 2:
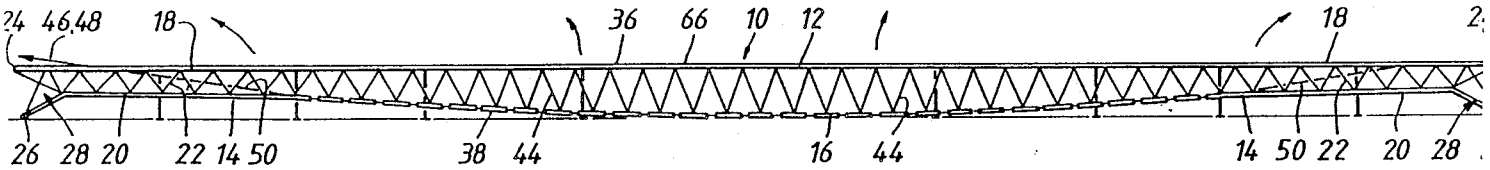
FIG. 2 is a side view along and in the direction of arrows 2—2 of a truss forming part of the building shown in FIG. 1, before erection.
Figure 3:
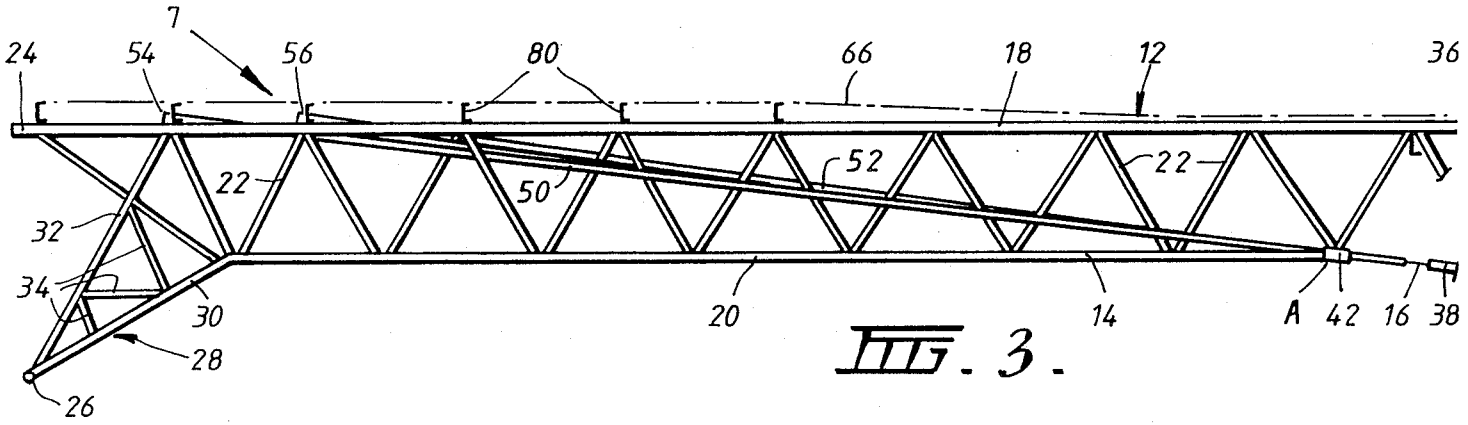
FIG. 3 is a side view of an end section of the truss shown in FIG. 2.
Figure 4:
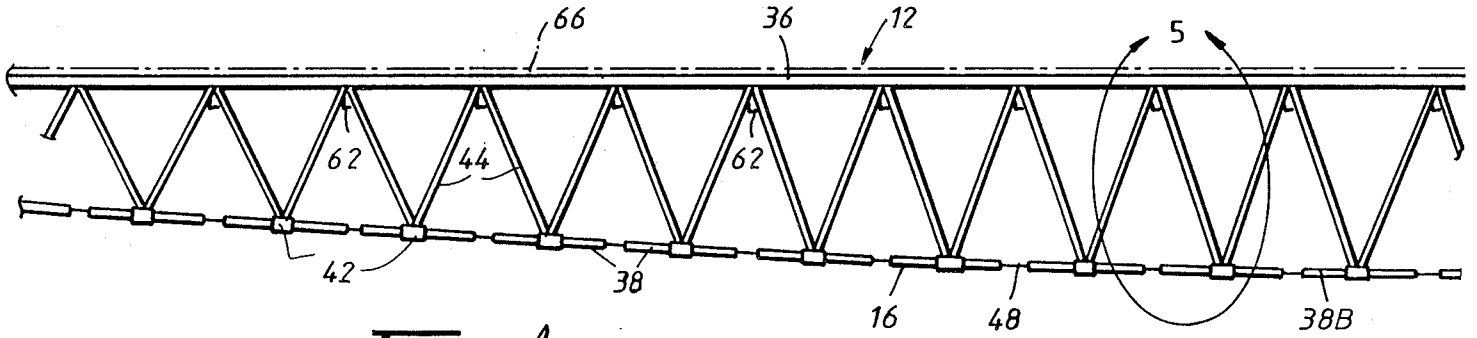
FIG. 4 is a side view of a part of the intermediate section of the truss shown in FIG. 2.
Figure 5:
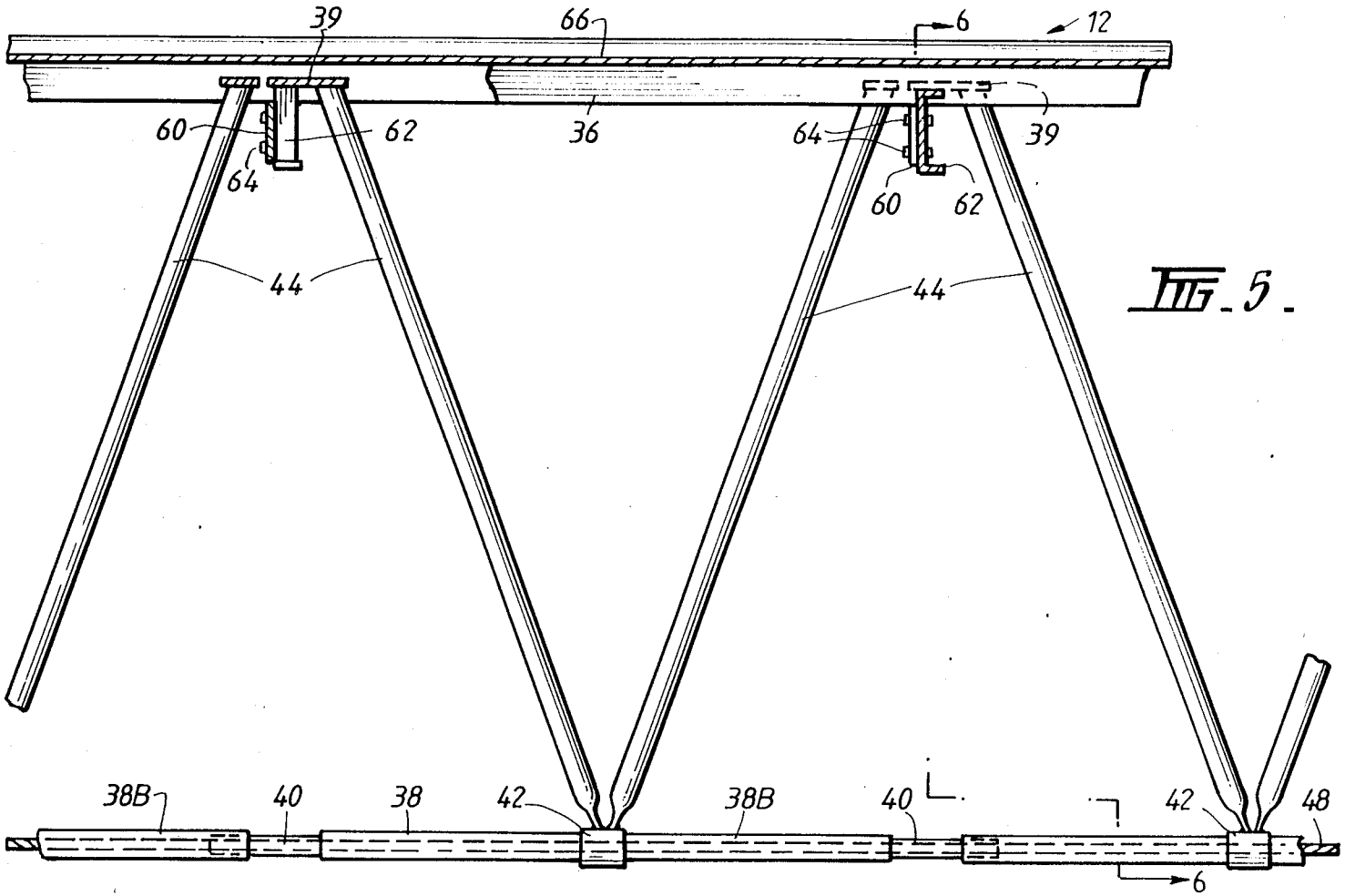
FIG. 5 is an enlarged view of the circled area "5" in FIG. 4.

As can be seen from FIGS. 2 and 4 lower chord 38 is downwardly bowed in its assembled condition. Cables 46 and 48 maintain this downwardly curved profile by emerging from intermediate section 16 at point A (see FIG. 3) and entering tubing 50 and 52 which bridges upper and lower chords 18 and 20 of end sections 14. Tension anchoring points 54, 56 are provided near the end of end sections 14 to anchor cables 46 and 48 when tensioning has been completed.

Figure 6:
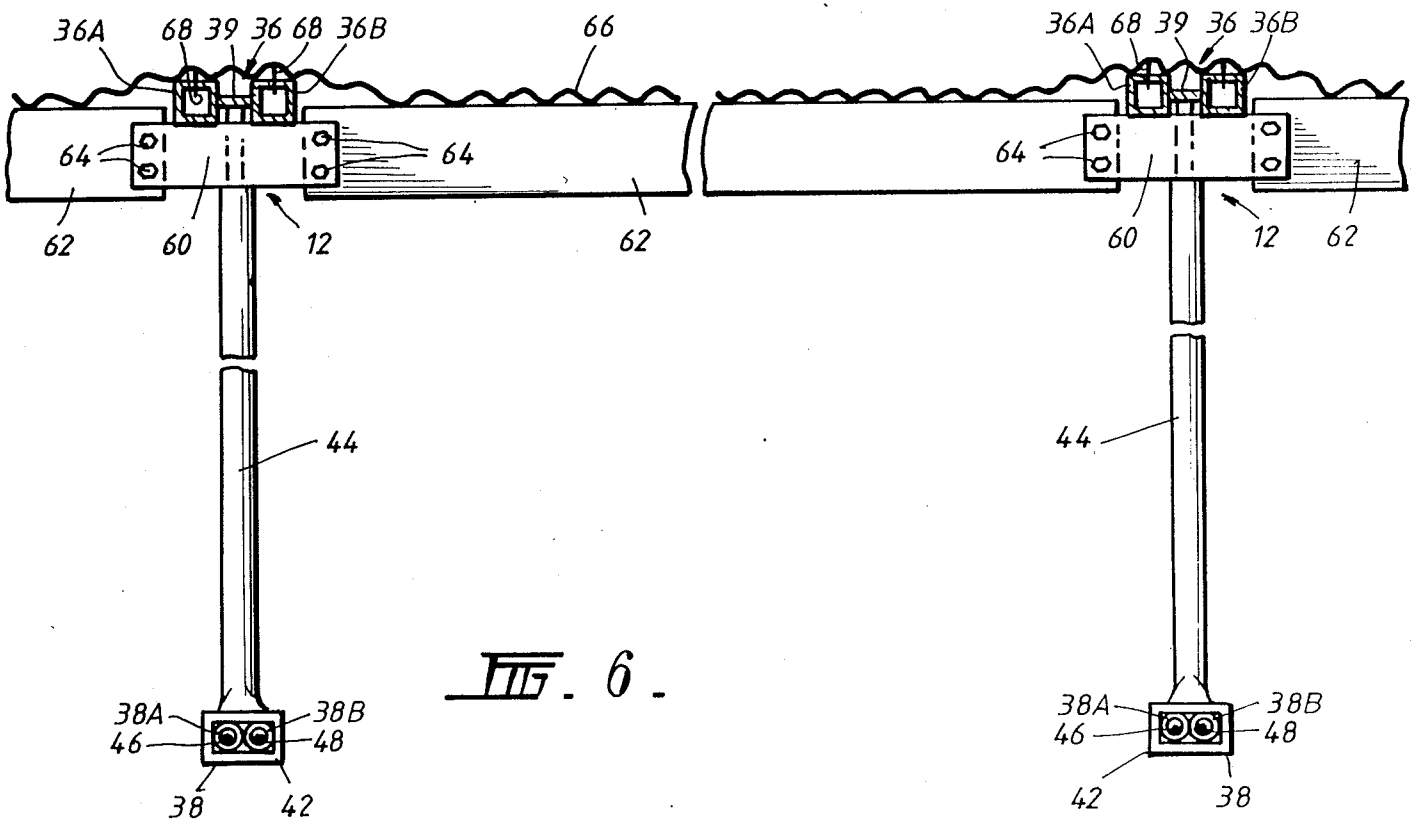
FIG. 6 is a cross-sectional view along and in the direction of arrows 6—6 in FIG. 5.
Figures 7, 8:
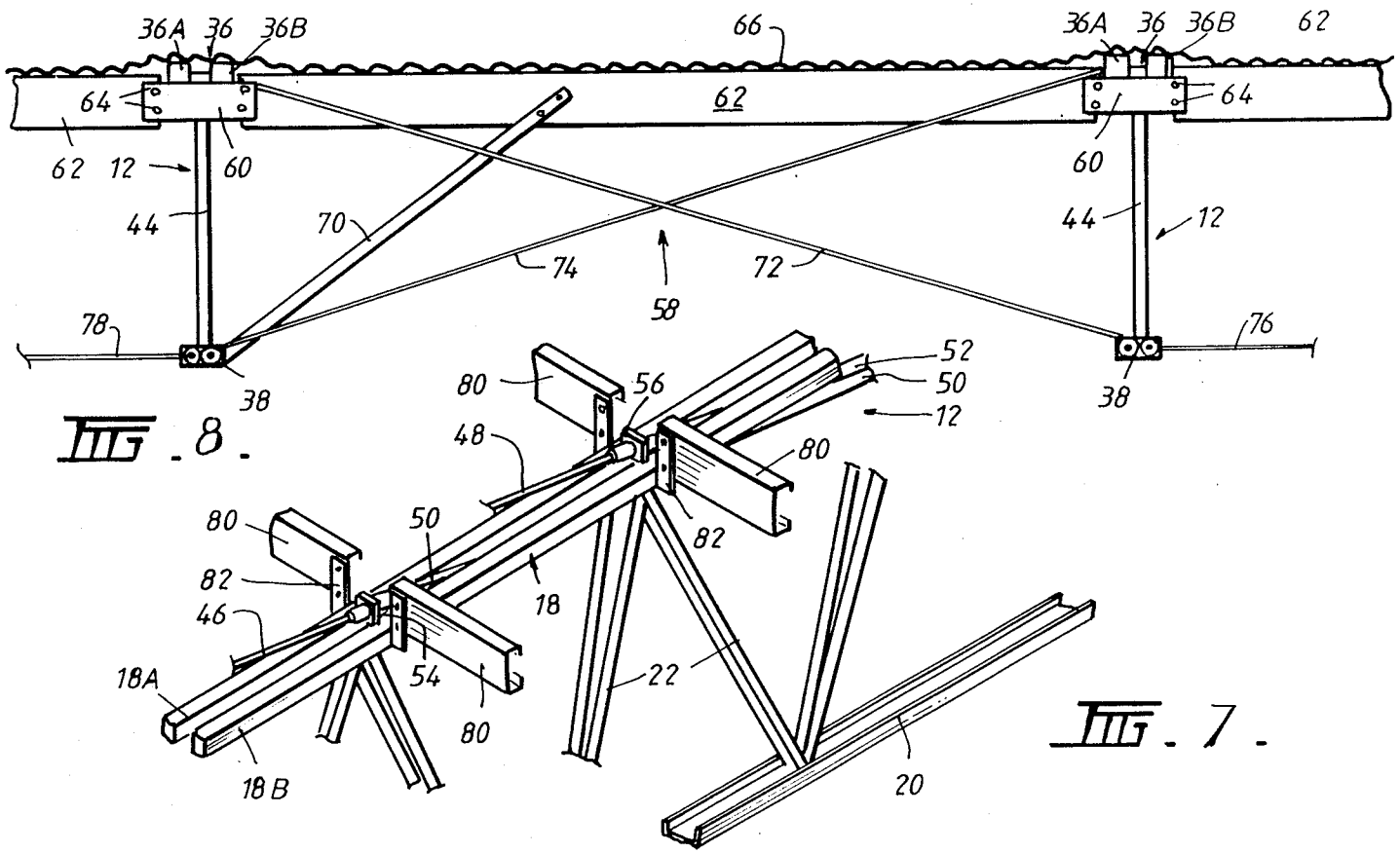
FIG. 7 is a view taken in the direction of arrow "7" shown in FIG. 3.
FIG. 8 is a view similar to FIG. 6 showing the lateral buckling restraint for the truss.

For lateral stability of the trusses 12 when coupled together to form a building, bracing 58 can be provided at selected positions on the intermediate section 16 and/or end sections 14. FIG. 8 illustrates a preferred embodiment for providing lateral stability on the intermediate section 16. Two trusses 12 each have a cleat 60 secured thereto and purlins 62 are attached between adjacent cleats by fasteners 64. FIG. 8. The purlins 62 are located below the upper surface of the upper chord 36 and allow, in the unstressed state, cladding 66 to rest thereon. Cladding 66 is secured to tubes 36A, 36B by fasteners 68 (see FIG. 6). A fly brace 70 is attached at one end to lower chord 38 and at the other end to purlin 62. Tension ties 72 and 74 are connected between upper and lower chords 36 and 38 and lie in the plane of diagonal web members 44 so as to permit the consequential decrease in the truss depth (normal to the upper chord) as the lower chords shorten during erection. The free ends 76 and 78 of tension ties 72 and 74 are joined to adjacent trusses (not shown).

Cladding 66 is secured to the end sections 14 by girts 80 (FIGS. 3 and 7) which are attached to cleats 82 on upper chord 18. Girts 80 lie above the upper surface of upper chord 18 which allows the use of conventional wall bracing for stiffening. Cladding 66 is unstressed in this region. This positioning is in contrast to that previously descried for purlins 62 where the purlins are below and within the upper chord with the preferred position such that the upper edge of the purlins are at or near the neutral axis of the upper chord 36. This situates the intermediate section cladding so as to be axially compressed during and by the erection process. The curved, axially compressed cladding, when properly affixed to the purlins and truss system stiffens the roof against general instability during erection, tends to support itself, and transfers some of its weight off the truss to the columns thereby reducing the load on the truss system and distributes loads applied in a directional normal to the plane of the truss during its working life.

The erection of a building made using the trusses of the present invention will now be described. The trusses 12 are assembled on site and laid parallel one with another as shown in FIGS. 1 and 2. The tubes 38A, 38B are telescoped into each other and cables 46, 48 are threaded therethrough and terminated at one end on the tension anchoring points 54, 56. In the illustrated embodiment the termination is at the right hand end in FIG. 2. Cladding 66 is secured to the trusses along with the bracings 58 whilst in the position shown in FIG. 2. A significant advantage of the present invention is that the assembly takes place at ground level thus reducing industrial accidents resulting from working at heights. The electrical installation work can also be performed at this time allowing considerable savings in time to be achieved. At the left hand side of FIG. 1 ground engaging points 26 are pivotally pinned to stationary ground base plates (not shown).

Figure 9:
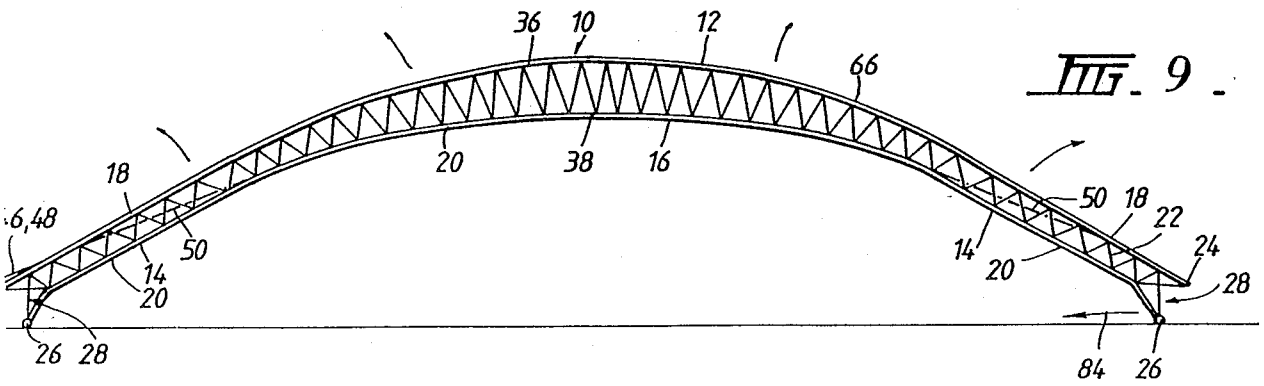
FIG. 9 is a view similar to that of FIG. 2 showing the truss in a partly-erected position.
Figure 10:
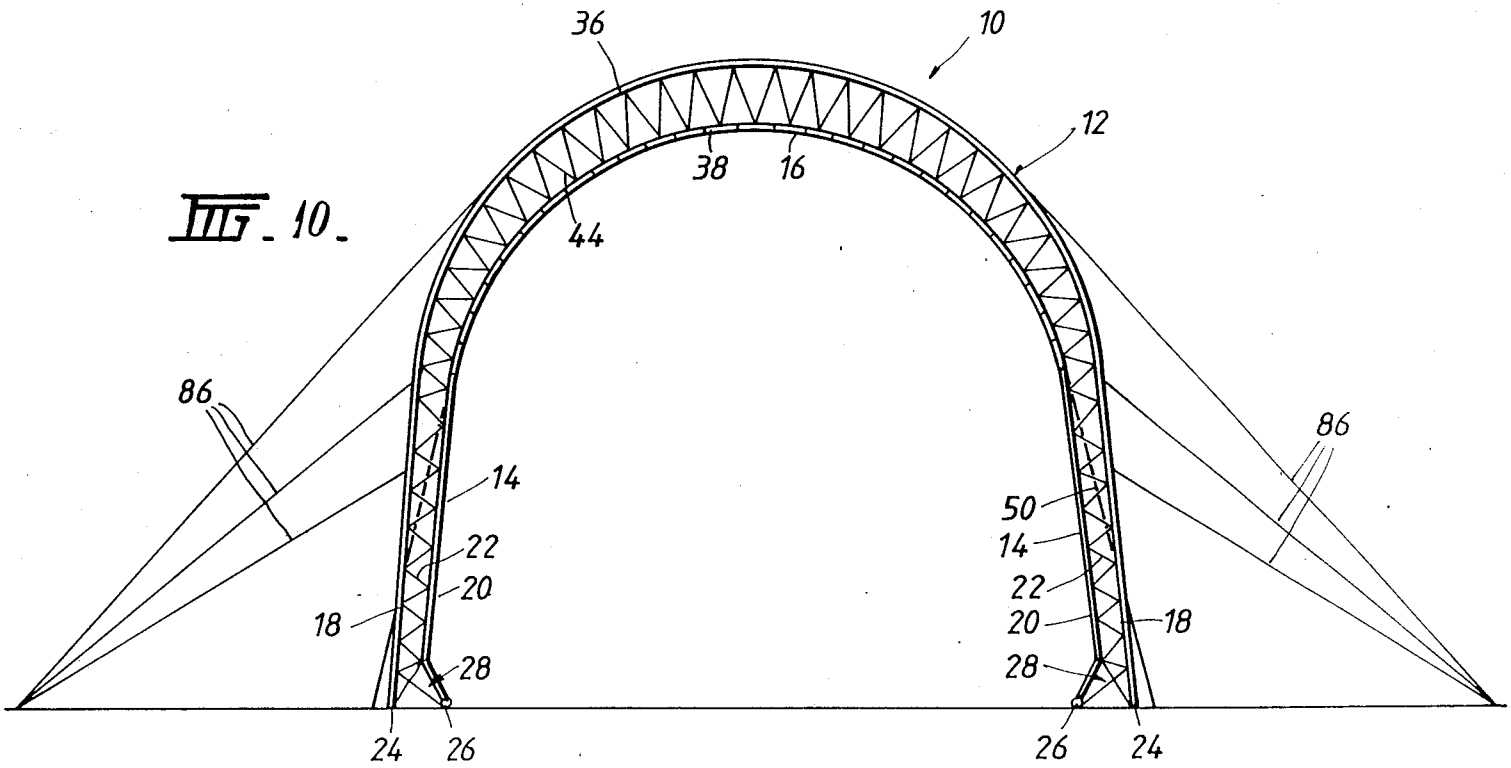
FIG. 10 shows the truss in its fully erected position with tensioned external cables.

The trusses are raised by the combined actions of an upwards force exerted upon the intermediate section 16 by the tensioning of the downwardly curved tension cables 46, 48 and the outwards rotation of the outer rigid end section 14 exerted by the pulling together of the ends of trusses by a temporary horizontal cable 84 (FIG. 9) at or just above ground level. The non-pivoted ground engaging points will slide along the ground and the truss will be lifted into the position shown in FIG. 9. The continued elevation of the intermediate section 16 is achieved by the controlled upwards buckling of the upper chord 36 restrained by the downwards force exerted on the truss by the upwards curved tension cables 46, 48 and the continued outwards rotation of the end sections 14 produced by the pulling together of the points 26 by the horizontal cable 84. The tubes 38A, 38B are shortened by their telescoping fitment until the trusses finally achieve their final shape (FIG. 10) when the tubes 38A, 38B abut adjacent tubes. The intermediate section 16 then stiffens up as no further flexure is permitted. The dotted line on FIG. 1 indicates the final width of the building. The intermediate section 16 may be further stiffened by the pre-compression of the lower chord tubes 38A, 38B by the application of additional tension to the high strength cables 46, 48. All ground engaging points are now secured to stationary ground base plates and cables 46, 48 are anchored at tension anchoring points 54, 56. FIG. 10 also shows that building 10 may be pre-loaded against superimposed lateral load by the means of tensioned steel cable stays 86.

In practice the invention can provide a building at least 10 storeys high which is suitable for aircraft and airship hangars. In view of the large undercover area achieved by the invention and the low cost involved the invention can be used to cover areas which could not previously be considered cost-effective.

It is believed that the invention and many of its attendant advantages will be understood from the foregoing description and it will be apparent that various changes may be made in the form, construction and arrangement of the parts and that changes may be made in the form, construction and arrangement of the truss described without departing from the spirit and scope of the invention or sacrificing all of its material advantages, the form hereinbefore described being merely a preferred embodiment thereof.

We claim:

1. A truss able to be used in the erection of a structure, said truss comprising at least one upper chord, at least one lower chord, and a plurality of diagonal web members joining said at least one upper chord to said at last one lower chord;

said truss having first and second relatively rigid end sections, said first end section being pivotally attached to a stationary ground base, and said second end section being slidable over the ground, said first and second end sections being joined by a relatively flexible intermediate section;

said at least one lower chord of said intermediate section being formed of a plurality of lengths of tube through which is threaded at least one high-tensile cable adapted for movement through the lengths of the tube, said at least one lower chord of said intermediate section being downwardly bowed prior to the erection of the structure;

wherein, by tensioning said at least one high tension cable, said at least one lower chord of said intermediate section is shortened to cause said at least one lower chord and said at least one upper chord of said intermediate section to bow upwardly and to shorten said at least one lower chord as to place said truss in an erect position, and wherein said at least one high-tensile cable emerges from said at least one lower chord of said intermediate section and is directed toward said at least one upper chord of the first and second end sections so as to intersect said at least one upper chord of said first and second end sections adjacent the ends of the truss.

2. The truss of claim 1, wherein said lower chord comprises at least two high tensile cables each of which is threaded through a plurality of lengths of tube.

3. The truss of claim 2, wherein said plurality of tubes telescope together before the shortening of said at least one lower chord of said intermediate section, there being provided a plurality of nodal connectors around certain of said tubes so as to support said at least one lower chord of said intermediate section.

4. A truss able to be used in the erection of a structure, said truss comprising at least one upper chord, at least one lower chord, and a plurality of diagonal web members joining said at least one upper chord to said at least one lower chord;

said truss having first and second relatively rigid end section, said first end section being pivotally attached to a stationary ground base, and said second end section being slidable over the ground, said first and second end sections being joined by a relatively flexible intermediate section;

said at least one lower chord of said intermediate section being formed of a plurality of lengths of tube through which is threaded at least one high-tensile cable adapted for movement through the lengths of tube, said at least one lower chord of said intermediate section being downwardly bowed prior to the erection of the structure;

wherein, by tensioning said at least one high tension cable, said at least one lower chord of said intermediate section is shortened to cause said at least one lower chord and said at least one upper chord of said intermediate section to bow upwardly and to shorten said at least one lower chord so as to place said truss in an erect position; and, wherein said plurality of tubes telescope together before the shortening of said at least one lower chord of said intermediate section, there being provided a plurality of nodal connectors around certain of said tubes so as to support said at least one lower chord of said intermediate section.

* * * * *